United States Patent [19]

Langenbach et al.

[11] Patent Number: 4,844,521

[45] Date of Patent: Jul. 4, 1989

[54] SECURITY DOOR LOCK

[76] Inventors: George Langenbach, 9127 Pardee Spur; John F. Lagenbach, 9017 Firewood Trail, both of St. Louis, Mo. 63126

[21] Appl. No.: 163,718

[22] Filed: Mar. 3, 1988

[51] Int. Cl.[4] ..... E05C 1/04

[52] U.S. Cl. ..... 292/143

[58] Field of Search ..... 292/143, 140, 142, 183, 292/189

[56] References Cited

U.S. PATENT DOCUMENTS

| | | | |
|---|---|---|---|
| 277,398 | 5/1883 | Wise | 292/140 |
| 325,846 | 9/1885 | Littlefield | 292/142 |
| 915,397 | 3/1909 | Weiss . | |
| 1,473,494 | 3/1922 | Miely . | |
| 1,653,487 | 12/1927 | White | 292/142 X |
| 2,717,064 | 9/1955 | Hock | 292/183 X |
| 4,070,074 | 1/1978 | Rohme | 312/245 |
| 4,294,040 | 10/1981 | Crotti | 49/254 |
| 4,607,510 | 8/1986 | Shanaan et al. | 292/140 X |
| 4,679,353 | 7/1987 | Langenbach | 49/257 |

FOREIGN PATENT DOCUMENTS

| | | | |
|---|---|---|---|
| 534497 | 1/1955 | Belgium | 292/143 |

*Primary Examiner*—Richard E. Moore

*Attorney, Agent, or Firm*—Senniger, Powers, Leavitt and Roedel

[57] ABSTRACT

This invention involves a security lock for a door hinged on a first door jamb for swinging between an open position and a closed position in which the door is positioned between the first door jamb and a second door jambs. The security lock comprises an elongate locking member mounted on or adjacent the second door jamb in an upright position wherein the locking member has a substantially continuous vertical surface extending at least a substantial portion of the full height of the door, and an actuator mechanism for effecting lateral movement of the locking member when it is mounted on or adjacent the second door jamb from a retracted position in which the locking member is clear of the door for permitting the door to be swung open from its closed position, to an extended locking position in which said substantially continuous vertical surface of the locking member overlaps a marginal portion of one face of the door to prevent the door from being swung open, the overlap between said locking member and said marginal portion of the door being substantially continuous along at least a substantial portion of the full height of the door.

9 Claims, 4 Drawing Sheets

SECURITY DOOR LOCK

BACKGROUND OF THE INVENTION

This invention relates generally to door locks, and more particularly to a security door lock which is especially designed to withstand attempts to force it open.

Ordinary doors can be kicked, pried or forced open, the portion of the jamb near a dead bolt being broken by the force. One approach to this problem is to build up or otherwise strengthen the jamb adjacent the bolt plate. Another approach, disclosed in U.S. Pat. Nos. 915,397 and 4,294,040, is to spread the force over the entire jamb or over the entire door frame.

U.S. Pat. No. 915,397 discloses a vault door movable by sliding and swinging. The door can be manually swung open and closed. When the door is closed, the outer edge of the vault door is slidable laterally into a vertical channel in the door jamb to protect against the door being blown open. The door is locked by rotation of a hand wheel, which turns a screw to drive two levers, thereby pushing the door (on pivot balls) into the channel in the door jamb. When the door slides into the channel, projections on the top and bottom of the door engage ribs on the top and bottom of the door frame, a bolt engages the inner edge of the door, and projections on the inner edge of the door enter recesses in the door jamb. However, this door is heavy and unwieldy to open and close, making it unsuitable for residential and many commercial buildings.

U.S. Pat. No. 4,294,040 discloses a two-part safety door for buildings and rooms which is intended for use in residential houses. The door comprises a door body and a supporting column, slidable from an unsecured position to a secured position wherein the outer vertical edge of the door body is received in a cavity in the jamb. The door can be locked in the secured position by vertical latches. When a handle is pulled, the door body and the supporting column slide on guides. In its unsecured position, the door body can rotate on hinges attached to the supporting column. Since both the door and the supporting column must be manually slid to secure this door, this door is unwieldy for many people and uses. In addition, the door and supporting column must be manually slid to the unsecured position.

U.S. Pat. No. 4,679,353, co-invented by the same inventors of this invention, discloses a security door which is capable of withstanding kicking or prying without breaking open and which may be easily opened by those, including handicapped people or children, who are authorized to do so. Means are provided so that the door may be shifted to its secured position without requiring the user to pull or push the door. Means are also provided for returning the door to its unsecured position when the door is unlocked. In addition to a secured position within the jamb, the door is capable of being latched or locked in the closed (but unsecured) position in the same way that a conventional door is locked. In particular, the security door comprises first and second vertical door jambs spaced from one another to define a doorway therebetween, and a door for closing the doorway. The second door jamb has a generally channel-shaped recess therein extending generally vertically from adjacent the bottom of the jamb to adjacent the top of the jamb. The security door includes a hinge on the first door jamb for supporting the door adjacent one vertical edge of the door, constituting its inner edge. The hinge enables the door to swing on a generally vertical axis between an open position wherein the door is swung out of the doorway and a closed position wherein the door closes the doorway and the opposite vertical edge of the door, constituting its outer edge, is spaced inwardly from the recess in the second door jamb. The door is movable outwardly in the plane of the doorway from its closed position to a secured position wherein the outer vertical edge is received in the vertical recess thereby to prevent the door from swinging out of its secured position. The security door further includes springs for urging the door away from its secured position and locking apparatus operable to pull the outer vertical edge of the door into the vertical recess and to maintain the door in its secured position against the urging of the springs. The locking apparatus comprises cooperable locking components in the door and the second door jamb. While the design and operation of this door are generally satisfactory, a special door jamb is required. Moreover a conventional door cannot readily be adapted to incorporate the features of the invention.

Accordingly, there is a need for a security lock which can be used to secure a door against kicking or prying without breaking open, and which is especially adapted to be fitted on conventional doors without undue effort.

SUMMARY OF THE INVENTION

Among the several objects of the invention may be noted the provision of an improved security lock for a door, particularly adapted to withstand attempts to force the door open, such as by kicking or prying; the provision of such a lock which can be applied to a conventional door to make it secure; the provision of such a lock which is quick and easy to operate; and the provision of such a lock which is efficient, durable and of low cost.

Generally, a security lock of the present invention is used for securing a door hinged on a first door jamb for swinging between an open position and a closed position in which the door is positioned between the first door jamb and a second door jamb. The security lock comprises an elongate locking member, means for mounting the locking member on or adjacent the second door jamb in an upright position wherein the locking member has a substantially continuous vertical surface extending at least a substantial portion of the full height of the door, the mounting means being adapted to permit lateral movement of the locking member relative to the second door jamb, and actuator means for effecting the aforesaid lateral movement of the locking member when it is mounted on or adjacent the second door jamb from a retracted position in which the locking member is clear of the door for permitting the door to be swung open from its closed position, to an extended locking position in which said substantially continuous vertical surface of the locking member overlaps a marginal portion of one face of the door to prevent the door from being swung open, the overlap between said locking member and said marginal portion of the door being substantially continuous along at least a substantial portion of the full height of the door.

This invention is also directed to a security door comprising first and second vertical door jambs spaced from one another to define a doorway therebetween, a door for closing said doorway having opposite faces disposed in spaced apart generally parallel vertical planes, and inner and outer vertical edge surfaces, and hinge means on the first door jamb supporting the door adjacent its inner edge surface and enabling the door to be swung on a vertical axis between an open position and a closed position wherein the door closes the doorway and its outer edge surface is facing the second door jamb. The security door also includes an elongate locking member, means mounting the locking member on or adjacent the second door jamb in an upright position wherein the locking member has a substantially continuous vertical surface extending at least a substantial portion of the full height of the door, the mounting means permitting lateral movement of the locking member relative to the second door jamb in a generally vertical plane, and actuator means for effecting lateral movement of said locking member from a retracted position in which the locking member is positioned for permitting the door to be swung open from its closed position, to an extended locking position in which said substantially continuous vertical surface of the locking member is positioned for engagement by a substantially continuous vertical surface of the door extending at least a substantial portion of the full height of the door thereby to prevent the door from being swung open.

Other objects and features will be in part apparent and in part pointed out hereinafter.

DESCRIPTION OF THE PREFERRED EMBODIMENT

Figure 1:
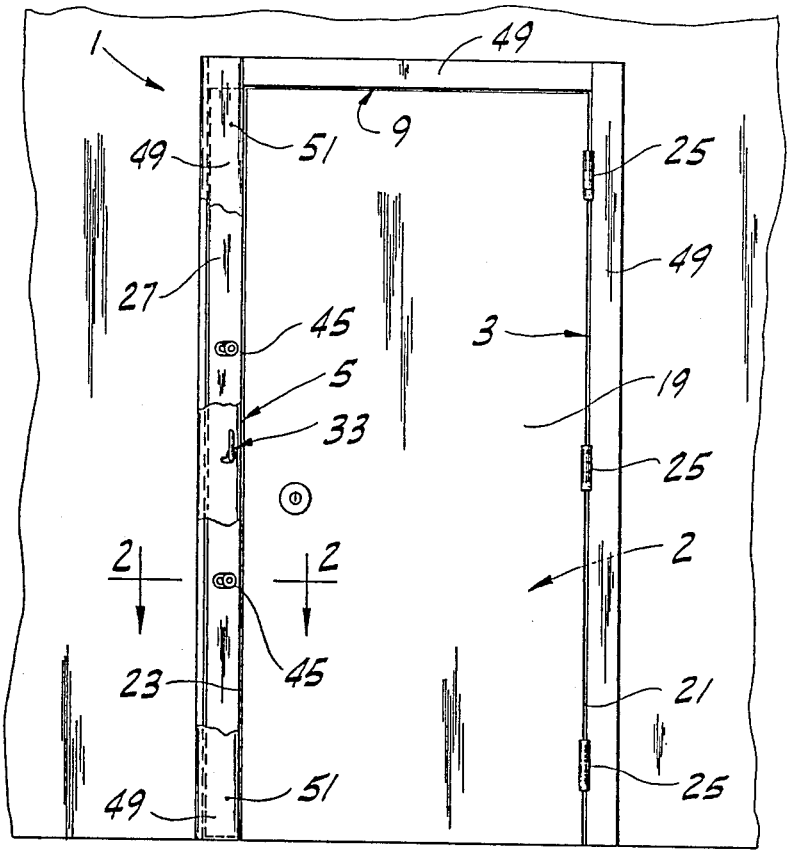
FIG. 1 is a front elevation of a security lock of the present invention as installed adjacent a door, the lock having a locking member shown in retracted position so the door can be opened.
Figure 2:
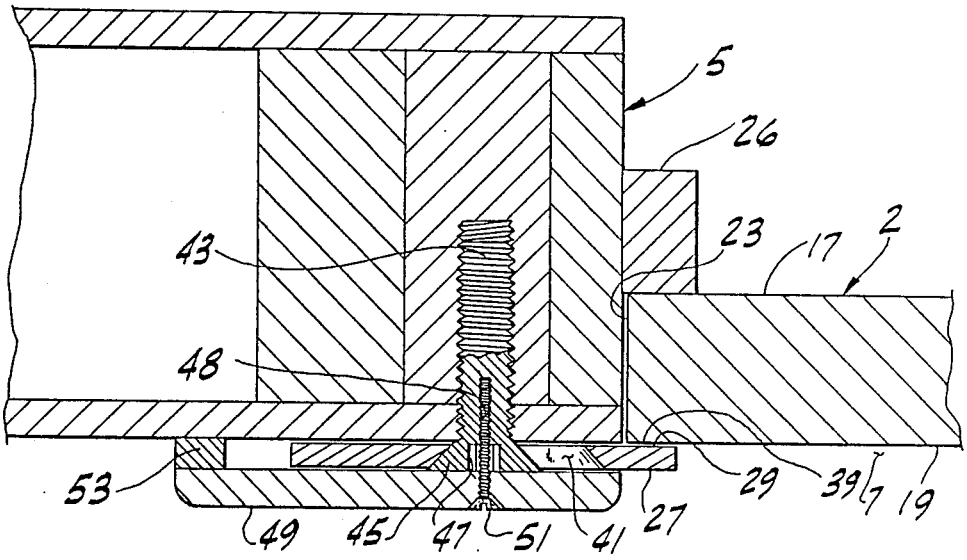
FIG. 2 is a cross-sectional view along line 2—2 of FIG. 1 showing the locking member extended to prevent the door from being opened.

Now referring to the drawings, a security lock of the present invention is designated in its entirety by the reference numeral 1. As shown in FIGS. 1 and 2, the security lock 1 may be used to secure a conventional door 2 disposed between first (right) and second (left) vertical door jambs designated 3 and 5, respectively, spaced from one another to define a doorway 7 therebetween. A conventional transom 9 spans the top of the doorway 7 between the left and right jambs. The door 2 is preferably a solid core door having opposite exterior faces 17,19 disposed in spaced apart generally vertical parallel planes, and inner (right) and outer (left) vertical edge surfaces indicated at 21 and 23, respectively. As shown in FIGS. 1 and 2, hinges 25 (constituting hinge means) are provided on the right door jamb 5 for supporting the door 2 adjacent its inner (right) vertical edge 21. The hinges enable the door to swing on a generally vertical axis between an open position wherein the door is swung inwardly out of the doorway 7 and a closed position (illustrated in FIGS. 1 and 2) wherein the door closes the doorway and the left (outer) vertical edge 23 of the door is facing the left vertical door jamb 5. The left door jamb 5 includes a door stop 26 for preventing the door from swinging outwardly completely through the doorway 7. The right door jamb 3 may be provided with a similar stop to inhibit tampering with the hinges and to provide an aesthetic balance corresponding to the stop 26 on the left jamb.

The security lock 1 comprises a locking member 27 in the form of an elongate, relatively narrow plate of heavy-gauge metal (e.g., ¼" treated aluminum plate) mounted to extend in an upright position on or adjacent the left vertical door jamb 5. The locking member 27 has a substantially continuous vertical surface 29 extending substantially the full height of the door 2, although it will be understood that the locking member need not extend the full height of the door so long as it extends at least a substantial portion thereof (e.g., at least 12"). Actuator means, generally designated 33, is provided for effecting lateral movement of the locking member 27 in a vertical plane from a retracted position (FIG. 1) in which the locking member 27 is clear of the door 2 so that it may be swung open, to an extended position (FIG. 2) in which the substantially continuous vertical surface 29 of the locking member 27 overlaps marginal portions 39 of face 19 of the door adjacent its left edge surface 25. This overlap is over an area of the door extending substantially continuously substantially the entire height of the door 2 (or at least a substantial portion thereof, such as a 12" portion) and prevents the door from being swung open.

Locking member 27 is slidably mounted on the left door jamb 5 by means of a plurality of vertically spaced pin-and-slot connections, each connection comprising a horizontal slot 41 in the locking member and a screw pin 43 threadably secured in the jamb and projecting outwardly through the slot. The screw pin has an enlarged flat head 45 with a counterbore 47 configured to receive an allen wrench. The flat head 45 is engageable with the exposed outer face of the locking member to hold the locking member in place against the door jamb 5. The horizontal slots 41 permit the locking member 27 to move laterally (from left to right and vice versa as illustrated in FIGS. 1 and 2). In its left-most position, locking member 27 is in a retracted position permitting the door 2 to be swung open. In its right-most position, locking member 27 is in an extended position so that its substantially continuously vertical edge surface 29 overlaps the door and is positioned for engagement by marginal portions 39 of face 19 of the door over an area of the face 19 which extends substantially continuously substantially the full height of the door 2 (or at least a substantial portion of the full height of the door, such as 12" or more).

In addition, the jambs 3 and 5 and transom 9 may be finished with molding 49. As shown best in FIG. 2, the moulding 49 along the left door jamb is secured in place by screws 51 threaded into tapped axial bores 48 in the screw pins 43. The inside face of the moulding abuts against the screw pin heads 45, the latter of which project slightly outwardly beyond the outer face of the locking member 27 to provide the necessary sliding clearance between the locking member and the moulding 49. To increase the attractiveness of this design, a vertical length of trim 53 may be installed to close the gap at the left side of the moulding (FIG. 2) between the wall and the moulding.

Figure 3:
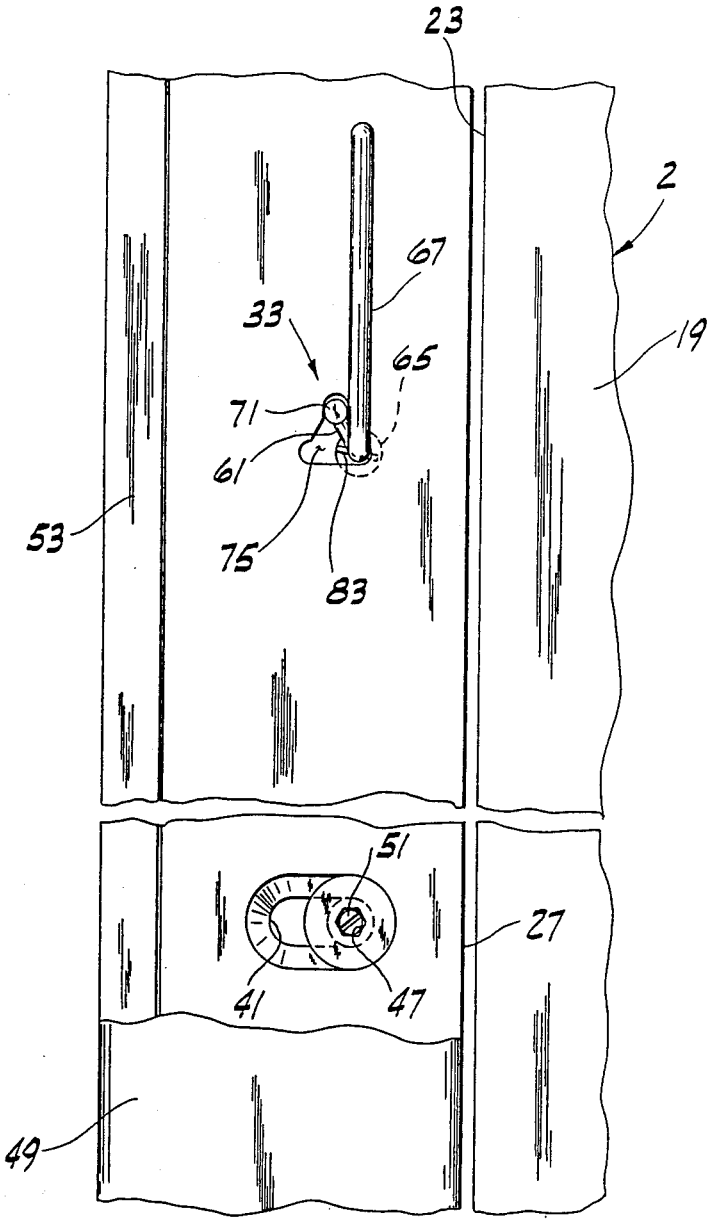
FIG. 3 is an enlarged portion of FIG. 1 showing an actuator mechanism for effecting lateral movement of the locking member, the locking member being shown in retracted position.
Figure 4:
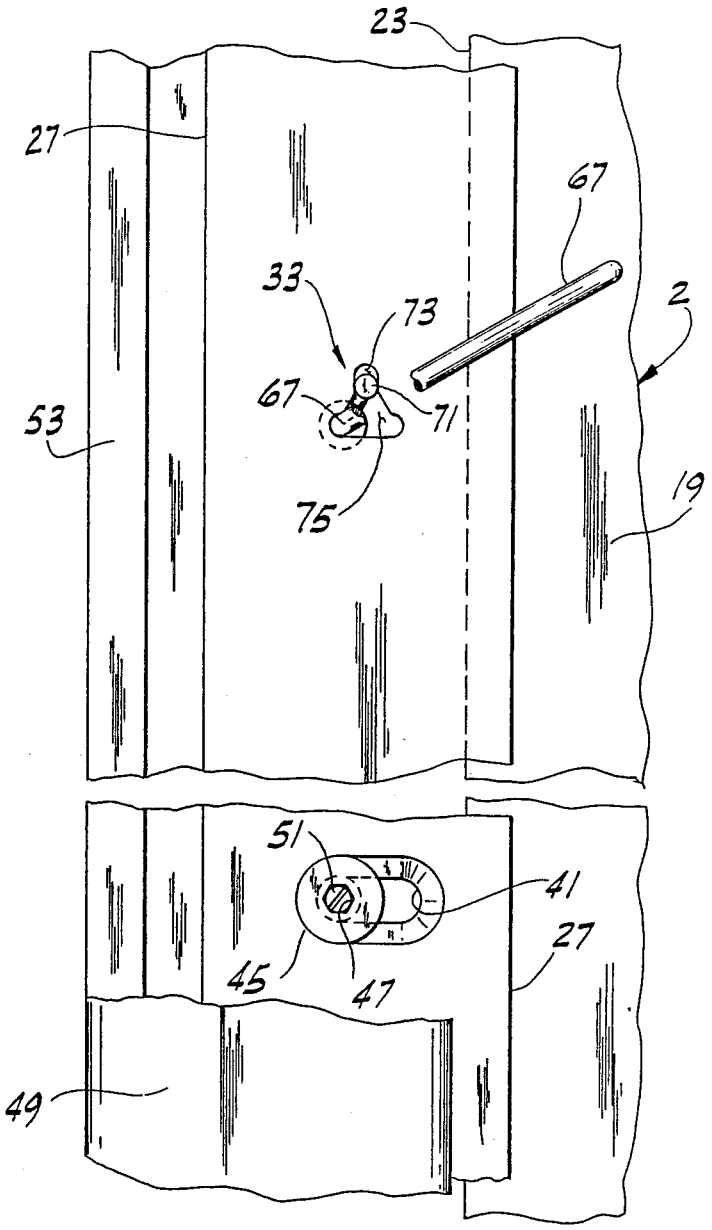
FIG. 4 is a top plan view, partially in section, of the actuator mechanism as illustrated in FIG. 3., showing the position of the actuator mechanism when the locking member is in its extended position.
Figure 5:
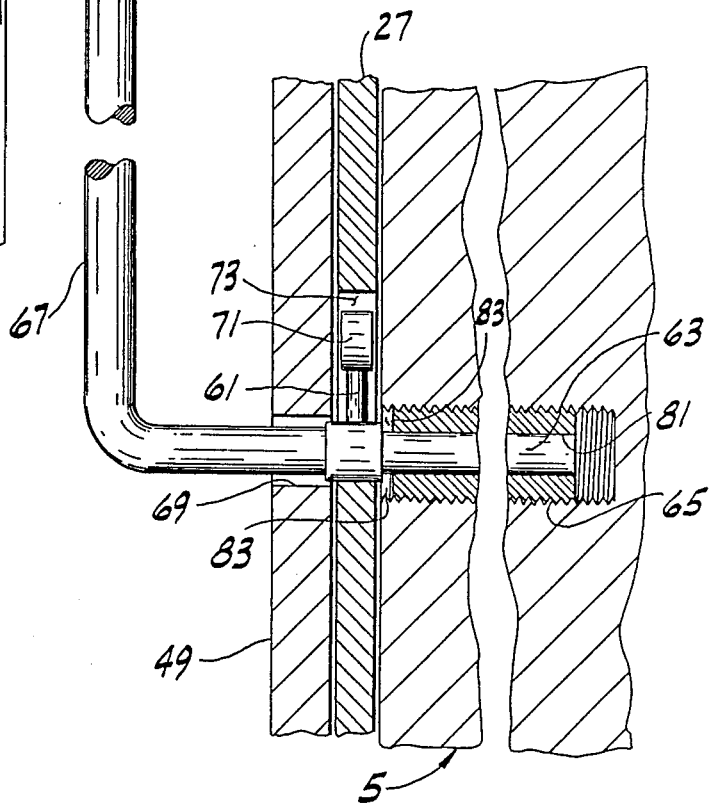
FIG. 5 is an enlarged sectional view of the actuator mechanism.

Referring to FIGS. 3–5, actuator means 33 is shown as comprising an actuator arm 61 mounted for rotation about a generally horizontal axis on a shaft 63 journalled in a bushing 65 (constituting bushing means) installed in the jamb 5. Rotation of the actuator arm 61 is effected by means of a handle 67 formed as an integral extension of the shaft 63 projecting outwardly through a hole 69 in the moulding 49. The actuator arm 61 has a rounded head 71 at its outer end received in a short extension 73 of a larger opening 75 in the locking member 27, the arrangement being such that clockwise rotation of the actuator arm 61 from the vertical position shown in FIG. 3 down to the angled position shown in FIG. 4 effects movement of the locking member to the right from its retracted position to its extended position, and counterclockwise rotation of the arm back to its vertical position effects movement of the locking member 27 back to its retracted position. The travel of the locking member should be such that it is clear of the door when it is retracted and overlaps the door at least one-half inch when extended to ensure adequate resistance against break-in. The opening 75 in the locking member 27 is sufficiently wide at its base to permit this travel without interference between the shaft 63 and the locking member.

The bushing 65 is the form of an externally threaded metal stud having a central axial bore 81 therethrough with a diameter only slightly greater than that of shaft 63 so that there is a close clearance fit between the two parts. One end of the stud is slotted as indicated at 83 to receive a tool for enabling the bushing to be threaded into the jamb 5. The shaft 63 is held captive in the bushing by the engagement of head 67 with the inside face of the moulding 49.

It is contemplated that other actuator means 33 for moving the locking member 27 between its extended and retracted positions may also be used without departing from the scope of this invention.

Figure 6:
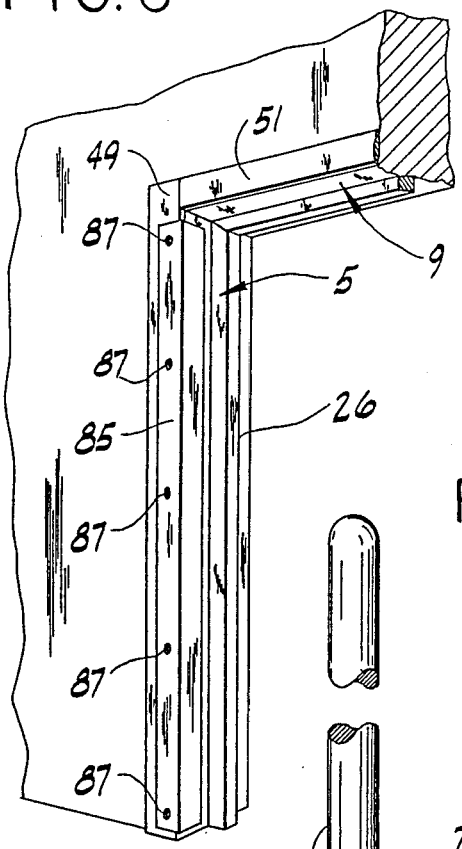
FIG. 6 is a view showing a template used in the installation of the security lock.

Installation of a security lock 1 of the present invention may be facilitated by the use of a template 85 formed from a length of angle bar stock having a series of holes 87 spaced at intervals corresponding to the desired spacing of screw pins 43 and bushing 65. Using the template as shown in FIG. 6, pilot holes are drilled in the moulding 49 and jamb 5, after which the trim is removed and the pilot holes in the jamb 5 enlarged to receive the screw pins and bushing. Once the locking member 27 and actuator mechanism 33 are installed, the moulding 49 is secured in place by threading screws 51 into the axial bores 48 in the screw pins 43.

It will be apparent from the foregoing that the security lock 1 of the present invention is easy to install and to operate to secure a conventional door 2. Thus, after swinging the door closed, it may be secured in position by grasping handle 67 and swinging it down to its FIG. 4 position, which moves the locking member 27 to its extended position. As a result, the door is securely locked and cannot be opened due to the abutment of marginal portions 39 of the door against locking member 27. Given the fact that this area of abutment extends substantially continuously for at least a substantial portion of the full height of the door (e.g., at least 12″), the door is effectively locked against forced entry.

In view of the above, it will be seen that the several objects of the invention are achieved and other advantageous results attained.

Furthermore, the invention contemplates that various modifications and/or additions can be included in the security lock according to the invention. For example, means (such as a lock) may be provided for selectively preventing the actuator means 33 from rotating to provide additional security. In addition, locking member 27 may be located at either side of the door 2, or two locking members may be installed at opposite sides of the door. Alternatively, the locking member 27 and actuating means 33 may be mounted on the door 2, with the locking member being laterally movable into a recess in or adjacent a door jamb.

As various changes could be made in the above constructions without departing from the scope of the invention, it is intended that all matter contained in the above description or shown in the accompanying drawings shall be interpreted as illustrative and not in a limiting sense.

What is claimed is:

1. A security door comprising:

first and second vertical door jambs spaced from one another to define a doorway therebetween;

a door for closing said doorway, said door having a pair of relatively wide generally parallel exterior faces adapted to span the width and height of the doorway when the door is closed, and inner and outer vertical edge surfaces;

hinge means on the first door jamb supporting the door adjacent its inner edge surface and enabling the door to be swung on a vertical axis between an open position and a closed position wherein the door closes the doorway and its outer edge surface is facing the second door jamb;

an elongated locking member; means mounting the locking member on or adjacent the second door jamb in an upright position wherein the locking member has a substantially continuous vertical surface extending at least a substantial portion of the full height of the door, said mounting means permitting lateral movement of the locking member relative to the second door jamb in a generally vertical plane generally parallel to the plane of the doorway; and actuator means associated with said locking member for effecting lateral movement of said locking member from a retracted position in which the locking member is positioned for permitting the door to be swung open from its closed position, to an extended locking position in which said substantially continuous vertical surface of the locking member is positioned for engagement by a substantially continuous vertical marginal portion of one of said exterior faces of the door extending at least a substantial portion of the full height of the door thereby to prevent the door from being swung open.

2. A security door as set forth in claim 1 wherein said locking member comprises an elongate locking plate of heavy-gage metal.

3. A security door as set forth in claim 2 wherein said locking plate is at least twelve inches long.

4. A security door as set forth in claim 2 wherein said locking plate has a length corresponding to substantially the full height of the door.

5. A security door as set forth in claim 1 wherein said mounting means comprises a plurality of generally horizontal slots spaced at intervals lengthwise of the locking plate, and a plurality of pins projecting outwardly from said second door jamb through said slots for supporting the locking plate and enabling it to be slidably moved between its retracted and extended positions.

6. A security door as set forth in claim 5 wherein each of aid pins comprises a screw pin threaded into said second door jamb and having an axial counterbore therein, and a plurality of screws threaded in the counterbores of the screw pins for holding moulding in place to cover said locking plate.

7. A security door as set forth in claim 5 wherein said actuator means comprises an actuator arm located and formed to be rotatable to a first position for sliding the locking plate to its extended position and rotatable to a second position for sliding the locking plate to its retracted position.

8. A security door as set forth in claim 7 further comprising bushing means mounted in said second door jamb, said actuator arm extending generally radially from a shaft rotatable in said bushing means about a generally horizontal axis.

9. A security door as set forth in claim 1 wherein said elongate locking member comprises an elongate locking plate lying in a plane generally parallel to said doorway, said security door further comprising moulding attached to said second door jamb overlying said locking member for substantially concealing the locking member from view when the locking member is in its said retracted position, said moulding being spaced from said second door jamb a distance greater than the thickness of said locking plate to enable the locking plate to move freely between its said extended and retracted positions.

* * * * *